United States Patent [19]

Kushigian

[11] 4,182,083

[45] Jan. 8, 1980

[54] GRINDING WHEEL FEED PROGRAMMER

[76] Inventor: Anthony Kushigian, P.O. Box 768, Hendersonville, N.C. 28739

[21] Appl. No.: 936,252

[22] Filed: Aug. 23, 1978

[51] Int. Cl.[2] ..... B24B 49/00

[52] U.S. Cl. ..... 51/165.79; 51/92 ND; 51/165.76

[58] Field of Search ..... 51/165 R, 165.78, 165.79, 51/165.75, 165.76, 92 ND

[56] References Cited

U.S. PATENT DOCUMENTS

| | | | |
|---|---|---|---|
| 2,469,077 | 5/1949 | Rickenmann | 51/165.78 |
| 3,768,213 | 10/1973 | Asano | 51/165.78 |
| 3,803,770 | 4/1974 | Abraham | 51/165.78 |
| 4,067,148 | 1/1978 | Kikuchi | 51/165.79 |

*Primary Examiner*—Harold D. Whitehead

*Attorney, Agent, or Firm*—Barnes, Kisselle, Raisch & Choate

[57] ABSTRACT

A mechanism for programming the number of increments of feed of a grinding wheel into a workpiece and the extent of the feed of each increment. The mechanism has a cam and a follower operably associated with a grinding wheel to feed the wheel toward a workpiece in response to rotation of the cam. A motor drives the cam and a dial in synchronization with the cam which has a plurality of dogs thereon which actuate limit switches to stop the motor and hence the feeding of the wheel into the workpiece. The number of increments in which the wheel is fed into the workpiece is a function of the number of dogs placed on the dial and the extent of the feed of each increment is a function of the angular position of the dogs on the dial.

4 Claims, 4 Drawing Figures

GRINDING WHEEL FEED PROGRAMMER

This invention relates to the feeding of the wheel of a grinding machine into a workpiece and more particularly to a mechanism for programming and controlling the feeding of the grinding wheel into a workpiece.

In grinding relatively deep grooves into a workpiece such as the flutes in a tap or drill it is necessary to make more than one cut or pass of the grinding wheel through the workpiece to produce a finished groove of the desired depth. For example, in making a tap with straight flutes, two to four rough cuts are usually made for each flute with the grinding wheel being advanced or fed further into the workpiece for each rough cut and then a finishing pass of the grinding wheel is made with little or no in-feed from the last rough cut to provide the desired surface finish of the flute. The number of cuts and the maximum depth of each cut required to produce a finished flute varies depending on the size of the flute and the grade of the steel from which it is being made.

Objects, features and advantages of this invention are to provide a grinding wheel feed programmer which permits the number of cuts or passes of the grinding wheel to be readily varied, permits the feed of the grinding wheel for each pass to be readily varied, may be easily and rapidly set up to provide the desired number of passes and feed for each pass of the grinding wheel, minimizes the amount of time required to complete grinding of a workpiece by permitting maximization of the depth of cut for each pass and minimization of the number of passes required to complete the grinding, simplifies the control circuitry of the grinding machine, improves the accuracy with which a workpiece may be ground, requires little in-service maintenance, and is rugged, durable and of relatively economical manufacture and assembly.

These and other objects, features and advantages of this invention will be apparent from the following etailed description, appended claims, and accompanying drawings in which:

Figure 1:
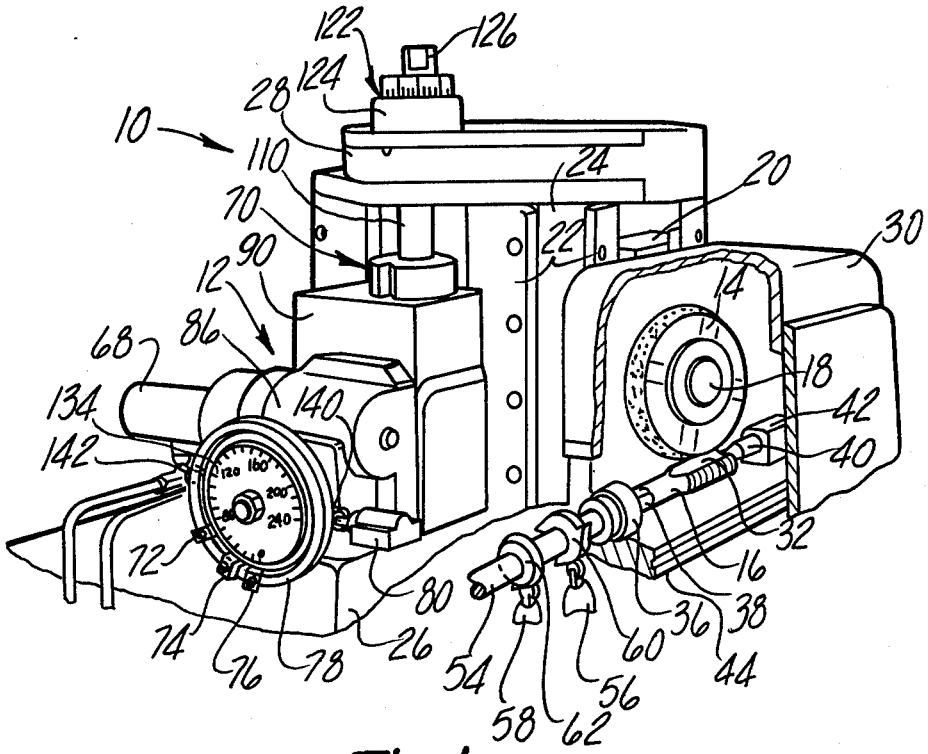
FIG. 1 is a fragmentary perspective view of a machine for grinding straight flutes in workpieces used in making taps which has a programmer embodying the invention.
Figure 2:
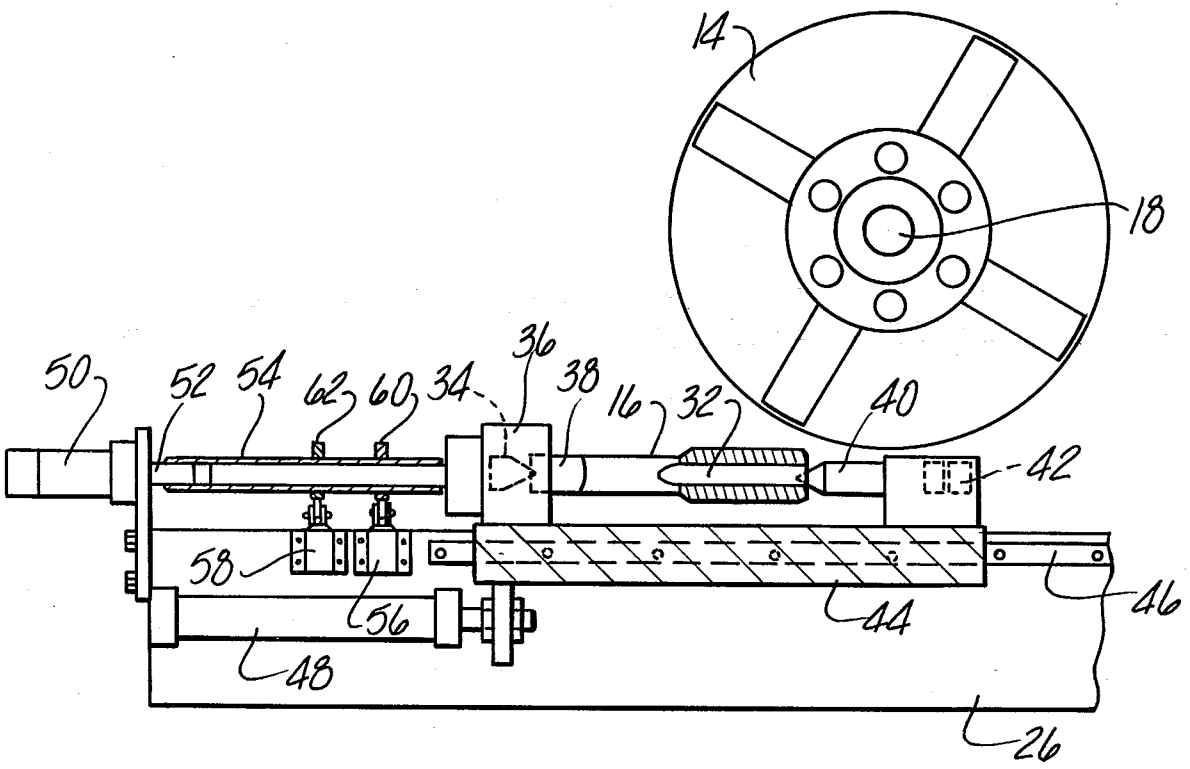
FIG. 2 is a fragmentary side view with portions broken away of the machine and programmermof FIG. 1.

Referring in more detail to the drawings FIGS. 1 and 2 illustrate a grinding machine 10 with a programmer 12 embodying this invention which controls the depth of the feed of a grinding wheel 14 into a workpiece 16 from which a tap is made. The grinding wheel is received on an arbor 18 journaled for rotation in a slide housing 20 and driven by an electric motor (not shown). To permit wheel 14 to be fed into and retracted from workpiece 16, slide housing 20 is mounted for generally vertical reciprocation on guideways 22 secured to upstanding posts 24 fixed to a base plate 26 of the machine. A casing 28 and a wheel cover 30 are secured to slide housing 20 for reciprocation therewith on the ways 22.

Wheel 14 grinds two or more flutes 32 in workpiece 16 which is positioned and supported in machine 10 between a center 34 of a chuck 36 in which the tang 38 of the shank of the workpiece is received and a center 40 which may be extended and retracted by a cylinder 42 to engage and release the workpiece. Chuck 36 and center 40 are carried by a table 44 which is reciprocated on ways 46 by a hydraulic cylinder 48 secured to the base plate. Workpiece 16 is rotated to and retained in predetermined angular positions by chuck 36 to permit grinding of two, three or four equally angularly spaced and axially extending flutes 32 in the workpiece 16 to produce a processed workpiece in which the flutes are in a desired angular orientation with respect to the tang 38 on the end of the shank of the workpiece. Chuck 36 is rotated by a fluid motor 50 coupled by telescoped shafts 52 and 54 to the chuck. The angular position and each complete revolution of the chuck is sensed by limit switches 56 and 58 actuated by cams 60 and 62 fixed to the shaft.

In accordance with this invention programmer 12 feeds the wheel 14 into the workpiece by rotation of a cam 64 secured to a shaft 66 driven by a fluid motor 68 and engaged by a follower assembly 70 connected to slide housing 20. The cycling of motor 68 and hence the rotation of cam 64 is programmed and controlled by a plurality of dogs 72, 74 and 76 releasably secured to a dial 78 fixed to the shaft 66 and positioned to trip a limit switch 80 to control through appropriate electrohydraulic circuitry (not shown) the fluid motor 68.

Figure 3:
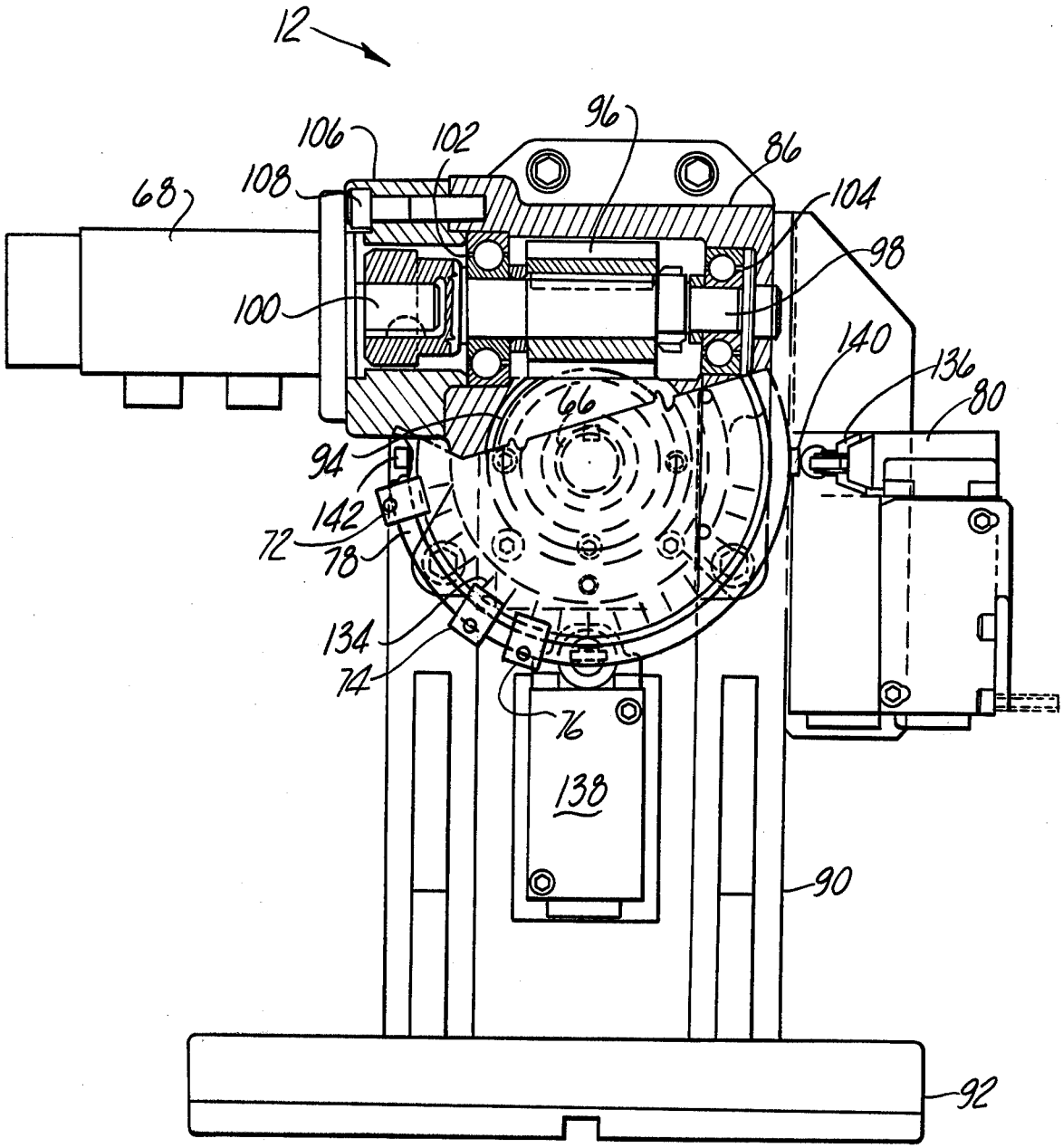
FIG. 3 is an end view with portions broken away and in section of the programmer of FIG. 1.
Figure 4:
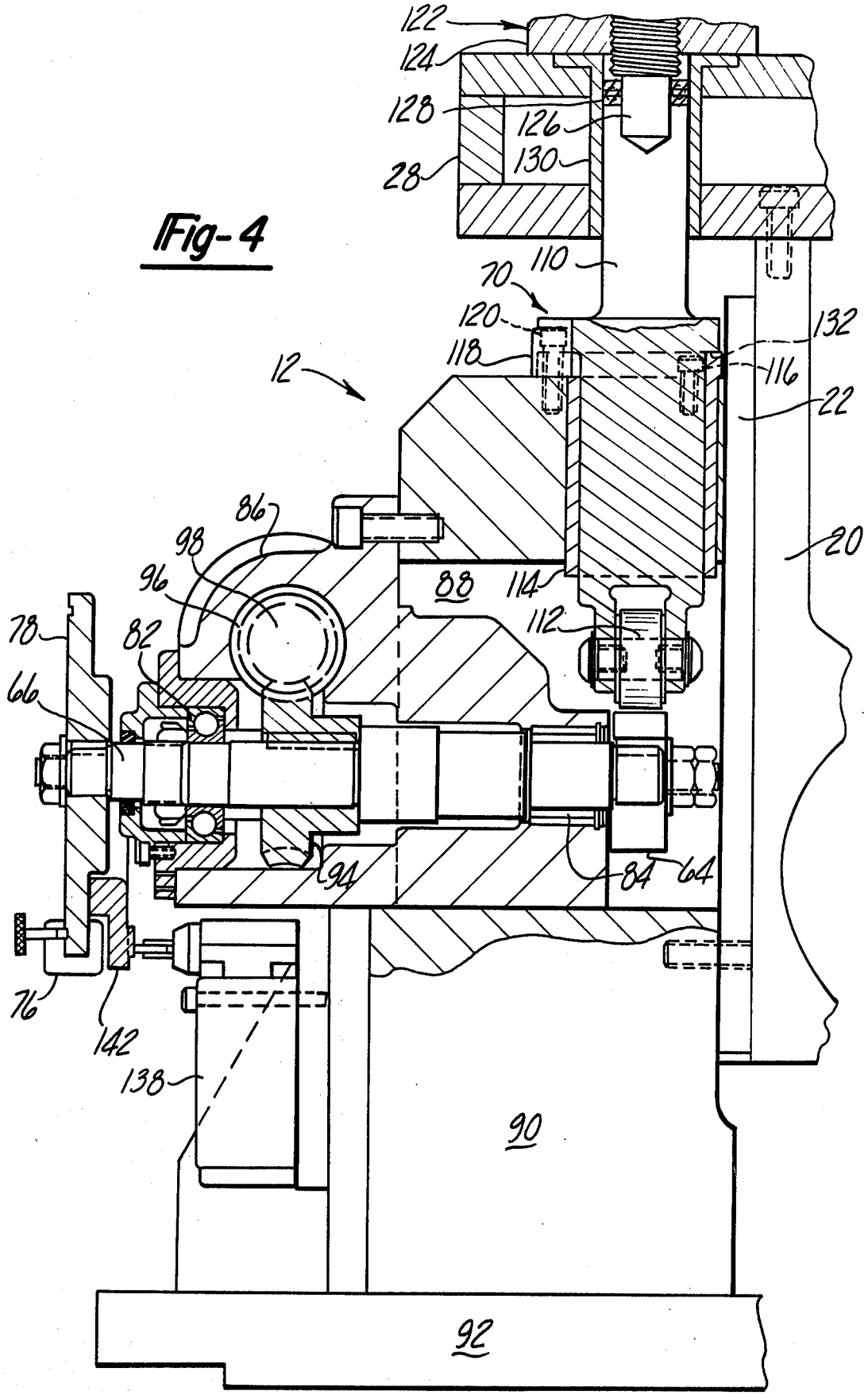
FIG. 4 is a fragmentary side view with portions broken away and in section of the programmer and associated portions of the grinding machine of FIG. 1.

As shown in FIGS. 3 and 4 the shaft 66 is journaled by bearings 82 and 84 in a housing 86 received in a cavity 88 in a mounting block 90 fixed to a mounting plate 92 which is secured to the base plate 26 of the machine. Motor 68 drives the shaft 66 through a gear 94 keyed to the shaft and a worm 96 keyed to a drive shaft 98 coupled to the output shaft 100 of the motor. Drive shaft 98 is journaled by ball bearings 102 and 104 in a cavity in housing 86 and motor 68 is mounted on a ring 106 secured to the housing by cap screws 108.

As shown in FIGS. 1 and 4, follower assembly 70 is connected to slide housing 20 through a push rod 110 journaled in casing 28 and having a follower roller 112 journaled on its lower end for engagement with the cam 64. Push rod 110 is slidably received in a bushing 114 received in block 90 and secured thereto by cap screws 116, and is prevented from rotating relative to the block by a stop 118 secured to the block by a cap screw 120.

To facilitate set up of grinding machine 10 slide housing 20 may be raised and lowered vertically independently of the programmer 12 by an adjustant mechanism 122 mounted on the casing 28. As shown in FIGS. 1 and 4 mechanism 122 has a ring 124 fixed to the casing in which a shaft 126 is threaded with its lower end extending through a thrust bearing 128 slidably received in a bushing 130 and bearing on the upper end of the push rod which is also received in the bushing.

To improve the accuracy with which machine 10 finish grinds a flute 32 in a workpiece cam 64 and follower assembly 70 are preferably constructed and arranged as shown in FIG. 4 so that during the last pass of the wheel when grinding each flute there is a slight gap 120 between the cam and follower roller 112, and a shoulder 132 of push rod 110 bears on the upper face of bushing 114 to provide a positive stop which both limits the feed of wheel 14 into the workpiece and accurately locates the wheel relative to the workpiece for the finish grinding of each flute. Cam 64 is constructed and arranged so that when it is rotated by shaft 66 clockwise as viewed in FIGS. 1 and 3 through one complete revolution it engages roller 112 and initially raises the grinding wheel 14 to a maximum height which preferably exceeds the maximum depth of the finished flutes to be produced in the workpiece and then lowers the grinding wheel at a uniform rate to its starting position with the shoulder 132 of the push rod 110 bearing on bushing 114 to provide a positive stop for the finish grinding of the flutes. Preferably cam 64 is shaped to produce the maximum rise or lift of the grinding wheel 14 in about the first quarter of a revolution of the cam, to lower or feed the wheel into the workpiece at a uniform rate throughout approximately the remaining three-quarters of a revolution of the cam, and to provide a slight dwell during which the cam is disengaged from the roller 112 of the follower assembly 70 between the raising and lowering of the grinding wheel.

Dial 78 has a graduated scale 134 thereon which indicates the distance in thousandths of an inch that rotation of the cam 64 will displace the wheel 14 from the fully lowered position. An indication that the cam 64 has moved the wheel 14 to the fully raised and fully lowered positions is provided by actuation of limit switches 136 and 138 by dogs 140 and 142 fixed to the dial 78.

In setting up machine 10 and programmer 12 to grind flutes 34 in workpieces 16, cam 64 is rotated so that follower assembly 70 is disengaged from the cam and bears on its positive stop, and then adjustment mechanism 122 is manipulated by manually rotating threaded shaft 126 to position wheel 14 for producing the maximum depth of the finished grooves in the workpiece. One dog for each feed of the wheel into the workpiece in grinding a single flute is placed on dial 78 and by using graduated scale 134 angularly positioned for the desired depth of cut. For example, if the maximum depth of the desired groove is 0.110 of an inch and it is to be ground in three passes of the wheel consisting of two rough cuts and one finish cut a dog 72 to control the first rough cut might be positioned at 0.050 of an inch on the dial, a second dog 74 to control the depth of the second rough cut might be positioned at 0.010 thousandths of an inch on the dial, and a dog 76 to control the finish cut might be positioned at 0.000 of an inch such as is shown in FIG. 1.

In use of machine 10 with programmer 12, drive motor 68 rotates dial 78 and cam 64 in unison clockwise as viewed in FIGS. 1 and 3 to cause the cam to engage roller 94 and raise follower assembly 46 and hence wheel 12 to its maximum height whereupon the fixed dog 140 on the back of dial 78 actuates limit switch 136 which through an appropriate electrohydraulic control circuit deenergizes and stops the fluid motor 68. With the wheel 14 in this fully raised position the workpiece to be machined is inserted, preferably by a transfer mechanism (not shown), into the grinding machine and engaged by chuck 36 and centers 34 and 40. When the transfer mechanism withdraws from the machine it trips a limit switch which through appropriate control circuitry energizes both the electric motor driving grinding wheel 14 and fluid motor 68 to rapidly rotate cam 64 and dial 78 clockwise in unison to rapidly traverse wheel 12 downward until dog 72 on the dial actuates limit switch 80 which through appropriate electrohydraulic control circuitry deenergizes and stops fluid motor 44 thereby positioning wheel 14 to produce the desired depth of the first rough cut. Through appropriate electrohydraulic control circuitry (not shown) this actuation of switch 80 also causes the workpiece 16 to be reciprocated by table 44 and indexed by chuck 36 to produce the first rough grinding pass of the wheel through the workpiece for each of the flutes to be produced therein. For example, if three flutes 32 are to be ground in the workpiece 16 the table will reciprocate the workpiece under the wheel three times and index the workpiece one-third of a revolution after each reciprocation of the workpiece by the table.

After the first rough grinding of the workpiece is completed by the machine the limit switch 58 which is tripped once for each revolution of chuck 36 will energize motor 68 through suitable electrohydraulic circuitry to rotate cam 64 and dial 78 in unison until the second dog 74 actuates limit switch 80 which through appropriate electrohydraulic circuitry deenergizes and stops the fluid motor when cam 64 has fed the wheel 14 downward toward the workpiece to produce the desired depth of the second rough cut of each of the flutes in the workpiece. This actuation of limit switch 80 also initiates the reciprocation by the work table and indexing by the chuck of the workpiece to produce the second rough grinding pass of the wheel through each of the flutes of the workpiece.

When the chuck 36 has been indexed one complete revolution limit switch 58 is again actuated which energizes fluid motor 68 to further rotate cam 64 and dial 78 clockwise until the third dog 76 actuates limit switch 80 which deenergizes and stops motor 50 when cam 64 has fully lowered follower assembly 70 so that it is engaged with its positive stop and the cam 40 is disengaged from roller 94 thereby very accurately positioning wheel 14 to produce the desired depth of cut for the final finishing pass of the grinding wheel through each of the flutes of the workpiece. This actuation of switch 80 also causes the workpiece to be reciprocated by the table and indexed by the chuck to finish grind each of the flutes in the workpiece. If no dog is located at the 0.000 of an inch position on the dial 78 motor 68 will be deenergized and stopped and reciprocation and indexing of the workpiece initiated after the follower assembly 70 has engaged its positive stop through appropriate control circuitry (not shown) energized by actuation of limit switch 138 by dog 142 on dial 78.

Upon completion of the finish grinding limit switch 58 is again actuated to energize fluid motor 68 to rotate cam 64 and dial 78 until dog 140 actuates limit switch 136 to deenergize and stop motor 68 when cam 64 has fully raised the grinding wheel and returned it to the start position. This actuation of switch 136 may also initiate cycling of the transfer mechanism to remove a finished workpiece from the machine 10 and insert another workpiece to be ground into the chuck 36 and centers 34 and 40 of the machine which upon retraction of the transfer mechanism can begin grinding the flutes in another workpiece.

The programmer 12 permits grinding machine 10 to be quickly and easily set up to grind flutes in workpieces such as taps and drills regardless of the number of passes of the grinding wheel required to produce a finished flute, the in-feed or depth of the cut desired for each pass of the wheel in grinding a flute, and the number of angularly spaced flutes to be ground in the workpiece. Moreover, the programmer minimizes the time required to grind the flutes in a workpiece by permitting the grinder to be set up for the minimum number of passes and the maximum depth of cut for each pass required to produce flutes in a wide range of sizes. Furthermore, the programmer can be quickly and easily set up for the desired number of passes and depths of cut to produce a finished flute by simply attaching a dog for each cut by the wheel on the dial of the programmer at the desired depth of cut as indicated by the graduated scale and this arrangement greatly simplifies the control circuits required for cycling the grinding machine.

I claim:

1. A grinding machine feed programmer for moving a grinding wheel toward a workpiece for making successively deeper material removing cuts along the same path through the workpiece, such programmer comprising a cam, a follower operably associated with said cam and the grinding wheel for moving the grinding wheel with respect to the workpiece in response to rotation of said cam, a disc operatively associated with said cam for rotation in synchronization with said cam, a motor operably connected with said cam and said disc for rotating said cam and said disc in synchronization with said cam, at least two dogs releasably carried by said disc in angularly spaced apart relation thereon, a switch constructed and arranged to be actuated by said dogs, and control means responsive to actuation of said switch and operatively associated with said motor to stop rotation of said cam and said disc by said motor in response to actuation of said switch by each of said dogs such that the number of increments in which the grinding wheel is advanced toward the workpiece for removing material from the workpiece is a function of the number of dogs carried by said disc and the extent of the feed of the grinder wheel toward the workpiece for each increment is a function of the angular spacing of said dogs on said disc.

2. The workpiece feed mechanism of claim 1 which also comprises a positive stop constructed and arranged to engage the follower when the follower is disengaged from the cam to position the grinding wheel with respect to the workpiece for the last of the successive cuts of the grinding wheel along the same path through the workpiece.

3. The feed mechanism of claim 1 wherein said switch comprises an electric switch having a pair of contacts the state of which is changed when the switch is actuated by each of said dogs and said motor comprises a fluid motor.

4. The mechanism of claim 1 which also comprises an adjustment mechanism operatively associated with said cam follower and said grinding wheel and constructed and arranged such that it can move said grinding wheel toward and away from the workpiece without changing the extent of the increments of feed of the grinding wheel toward the workpiece provided by the programmer.

* * * * *

UNITED STATES PATENT AND TRADEMARK OFFICE

CERTIFICATE OF CORRECTION

PATENT NO. : 4,182,083

DATED : January 8, 1980

INVENTOR(S) : Anthony Kushigian

It is certified that error appears in the above-identified patent and that said Letters Patent are hereby corrected as shown below:

In column 1, lines 39-40, delete "e-tailed" and insert -- detailed --.
In column 1, line 47, delete "programmermof" and insert -- programmer of --.
In column 2, line 46, delete "set up" and insert -- setup --.
In column 2, line 60, delete "120".
In column 3, line 47, delete "94" and insert -- 112 --.
In column 3, line 47, delete "46" and insert -- 70 --.
In column 3, line 48, delete "12" and insert -- 14 --.
In column 3, line 61, delete "12" and insert -- 14 --.
In column 3, line 64, delete "44" and insert -- 68 --.
In column 4, line 29, delete "40" and insert -- 64 --.
In column 4, line 30, delete "94" and insert -- 112 --.

Signed and Sealed this

*Twenty-seventh* Day of *May 1980*

[SEAL]

*Attest:*

SIDNEY A. DIAMOND

*Attesting Officer*

*Commissioner of Patents and Trademarks*